US009517865B2

(12) United States Patent
Albers et al.

(10) Patent No.: US 9,517,865 B2
(45) Date of Patent: Dec. 13, 2016

(54) AIRTIGHT CANISTER LID WITH FLEXIBLE SEAL-BREAKING BULB

(76) Inventors: Oliver Albers, Oakland, CA (US); Kun Shu Jeffrey Lin, Taipei (TW)

( * ) Notice: Subject to any disclaimer, the term of this patent is extended or adjusted under 35 U.S.C. 154(b) by 1138 days.

(21) Appl. No.: 11/951,749

(22) Filed: Dec. 6, 2007

(65) Prior Publication Data

US 2009/0090714 A1 Apr. 9, 2009

(30) Foreign Application Priority Data

Oct. 9, 2007 (TW) ..... 96216905 U
Oct. 18, 2007 (CN) ..... 200720177216

(51) Int. Cl.

*B65D 39/00* (2006.01)
*B65D 51/16* (2006.01)
*B65D 53/00* (2006.01)
*B65D 43/02* (2006.01)

(52) U.S. Cl.

CPC ... *B65D 43/022* (2013.01); *B65D 2543/00092* (2013.01); *B65D 2543/00222* (2013.01); *B65D 2543/00296* (2013.01); *B65D 2543/00509* (2013.01); *B65D 2543/00546* (2013.01); *B65D 2543/00851* (2013.01); *B65D 2543/00935* (2013.01)

(58) Field of Classification Search

USPC ..... 215/296, 298, 355, 363, 364, 53, 262,215/270, 343, 344, 346, 350, 358; 220/203.13, 220/203.14, 578, 580, 789, 791, 800, 801–805, 220/213, 231, 240, 271, 366.1, 756, 287, 379; D9/443; 4/295; 422/556, 910; 206/829

See application file for complete search history.

(56) References Cited

U.S. PATENT DOCUMENTS

| | | | | | |
|---|---|---|---|---|---|
| 41,392 | A | * | 1/1864 | Parker | 215/307 |
| 47,238 | A | * | 4/1865 | Whitall | 215/227 |
| 47,834 | A | * | 5/1865 | Imlay | 215/277 |
| 49,916 | A | * | 9/1865 | Perry et al. | 215/355 |
| 82,629 | A | * | 9/1868 | Needham | 16/417 |
| 150,472 | A | * | 5/1874 | Hucks | 220/800 |
| 221,468 | A | * | 11/1879 | Lane | 220/256.1 |
| 324,492 | A | * | 8/1885 | Schwab | 4/295 |
| 425,113 | A | * | 4/1890 | Susemihl | 4/295 |
| 506,872 | A | * | 10/1893 | Chase | 4/292 |
| 561,783 | A | * | 6/1896 | Fuerth | 215/260 |
| 599,460 | A | * | 2/1898 | Thomas | 222/562 |
| 606,822 | A | * | 7/1898 | Legrand | 215/262 |
| 677,900 | A | * | 7/1901 | Stern | 215/355 |
| 697,036 | A | * | 4/1902 | Stern | 215/355 |
| 731,792 | A | * | 6/1903 | Kunkel | 215/290 |
| 742,652 | A | * | 10/1903 | Hirst | 215/298 |

(Continued)

FOREIGN PATENT DOCUMENTS

WO 0026106 5/2000

OTHER PUBLICATIONS

Bulb—The Free Online Dictionary, Thesaurus and Encyclopedia.*

(Continued)

*Primary Examiner* — Anthony Stashick
(74) *Attorney, Agent, or Firm* — Onello & Mello, LLP.

(57) ABSTRACT

A canister comprises a vessel defining a volume and an opening having a rim and a lid. The lid comprises a flexible bulb and a conformal outer edge configured to create an airtight vacuum seal with the rim to close the opening. The flexible bulb is configured to release pressure from the vessel and break the airtight vacuum seal in response to compression of the bulb. The lid can be configured to be completely contained within the rim.

15 Claims, 13 Drawing Sheets

(56) References Cited

U.S. PATENT DOCUMENTS 759,830 A * 5/1904 Ricke ..... 215/233
798,507 A * 8/1905 Hally ..... 220/288
871,697 A * 11/1907 Hofheimer ..... 215/302
909,284 A * 1/1909 Colling ..... 126/381.1
1,032,490 A * 7/1912 Miller ..... 215/364
1,254,251 A * 1/1918 Magnus ..... 220/719
1,370,170 A * 3/1921 Ullman ..... 4/295
1,384,038 A * 7/1921 Becker ..... 4/295
1,403,423 A * 1/1922 Le Duc ..... 4/295
1,437,572 A * 12/1922 Vons ..... 215/298
1,440,349 A * 12/1922 Foltz ..... 215/355
1,491,325 A * 4/1924 Thomas, Jr. ..... 220/305
1,544,553 A * 7/1925 Brady ..... 215/274
1,651,669 A * 12/1927 Carpmael ..... 215/316
1,683,345 A * 9/1928 Geyer ..... 220/378
1,754,793 A * 4/1930 Jefferys ..... 220/801
1,815,569 A * 7/1931 Johnson ..... 99/349
1,818,924 A * 8/1931 Basmadjian ..... 215/231
1,898,342 A * 2/1933 Cuthbert ..... 215/329
1,947,915 A * 2/1934 Marschall ..... 222/525
1,978,025 A * 10/1934 McCown ..... 220/580
1,985,788 A * 12/1934 Gore-Lloyd ..... 215/262
2,024,532 A * 12/1935 Mancuso et al. ..... 215/262
2,040,798 A * 5/1936 Schoonmaker ..... 215/271
2,072,366 A * 3/1937 Hein ..... 604/212
2,106,880 A * 2/1938 Toaz ..... 53/485
2,148,995 A * 2/1939 Nelson ..... 301/37.31
2,156,585 A * 5/1939 Enkur ..... 215/277
2,157,624 A 5/1939 Overmyer
2,172,457 A * 9/1939 Schwartz ..... 220/578
2,173,843 A * 9/1939 Hothersall ..... 220/799
2,187,396 A * 1/1940 Glocker ..... 215/262
2,228,936 A * 1/1941 Walter ..... 215/262
2,266,270 A * 12/1941 Roth ..... 215/317
2,299,730 A * 10/1942 Bornstein ..... 220/718
2,313,845 A * 3/1943 Sundholm ..... 222/387
2,429,984 A * 11/1947 Berglund ..... 137/859
2,451,194 A * 10/1948 Braun ..... 248/544
2,487,635 A * 11/1949 Carpenter ..... 4/295
2,503,944 A * 4/1950 Frascari ..... 53/440
2,582,489 A * 1/1952 Krueger ..... 215/262
2,663,451 A * 12/1953 Yarnall ..... 220/805
2,709,046 A * 5/1955 Hyde ..... 4/295
2,716,504 A * 8/1955 Martin ..... 215/334
2,726,012 A * 12/1955 Jensen ..... 220/580
2,801,021 A * 7/1957 Wood ..... 220/233
2,828,886 A * 4/1958 Thomas ..... 220/579
2,858,989 A * 11/1958 Jordan ..... 241/46.015
2,870,906 A * 1/1959 Harkness et al. ..... 206/63.3
2,907,467 A * 10/1959 Machate, Jr. ..... 210/469
2,916,174 A * 12/1959 Orr ..... 215/277
2,946,606 A * 7/1960 Smith ..... 277/625
2,953,272 A * 9/1960 Mumford et al. ..... 215/260
2,966,276 A * 12/1960 Hing ..... 215/270
2,997,397 A * 8/1961 Doulgheridis ..... 426/402
3,005,996 A * 10/1961 Hyde ..... 4/295
3,080,993 A * 3/1963 Livingstone ..... 220/305
3,142,409 A * 7/1964 Ross ..... 220/281
3,163,311 A * 12/1964 Stolk ..... 426/106
3,163,314 A * 12/1964 Mauser ..... 220/305
3,164,289 A * 1/1965 Cocchiarella ..... 220/578
3,244,308 A * 4/1966 Esposito, Jr. ..... 215/270
3,250,417 A * 5/1966 Powers, Jr. et al. ..... 215/321
3,315,872 A * 4/1967 Carbone ..... 215/233
3,317,069 A * 5/1967 Chin ..... 215/353
3,405,832 A * 10/1968 Lukesch et al. ..... 215/355
3,414,160 A 12/1968 Weber
3,416,712 A * 12/1968 Shastal ..... 222/541.5
3,465,923 A * 9/1969 Konefal ..... 222/498
3,490,083 A * 1/1970 Firth ..... 4/295
3,559,843 A * 2/1971 Kern ..... 220/281
3,561,668 A * 2/1971 Bergstrom ..... 229/123.1
3,672,114 A 6/1972 Sacks
3,692,208 A * 9/1972 Croyle et al. ..... 220/789
3,727,808 A * 4/1973 Fitzgerald ..... 222/482
3,730,399 A 5/1973 Dibrell et al.
3,744,657 A * 7/1973 Alpern ..... 215/364
3,784,051 A * 1/1974 Shaw et al. ..... 220/580
3,797,696 A * 3/1974 Dibrell ..... 220/714
3,825,143 A * 7/1974 Julian ..... 215/206
3,901,405 A * 8/1975 Norberg ..... 220/287
3,924,774 A 12/1975 Donnelly
3,987,941 A * 10/1976 Blessing ..... 222/386
4,016,999 A 4/1977 Denzer
4,027,776 A 6/1977 Douglas
4,125,210 A * 11/1978 Embree ..... 222/570
4,149,650 A * 4/1979 Whelchel et al. ..... 220/201
4,218,967 A 8/1980 Batchelor
4,227,620 A * 10/1980 Conway ..... 215/355
4,270,666 A * 6/1981 Beckman ..... 215/364
4,287,996 A * 9/1981 Wanderer ..... 217/108
4,303,171 A * 12/1981 Schremmer ..... 220/238
4,320,932 A * 3/1982 Giffin ..... 312/71
4,334,632 A * 6/1982 Watanabe ..... 220/787
4,355,729 A * 10/1982 Maguire ..... 215/215
4,360,119 A * 11/1982 Olivo ..... 220/522
4,393,979 A * 7/1983 Ball et al. ..... 220/270
4,413,748 A * 11/1983 Kessler et al. ..... 220/281
4,482,047 A * 11/1984 Ackermann et al. ..... 206/219
4,500,006 A * 2/1985 Lafortune et al. ..... 215/224
4,504,996 A * 3/1985 Loos ..... 15/105
4,531,651 A * 7/1985 Donnelly ..... 215/354
4,537,325 A * 8/1985 Zieff ..... 220/234
4,538,741 A * 9/1985 Jacobs ..... 215/320
4,544,074 A * 10/1985 Evans ..... 215/355
4,592,483 A * 6/1986 Scouten ..... 220/379
4,645,096 A * 2/1987 Grant ..... 222/153.09
4,673,814 A * 6/1987 Schroeder et al. ..... 250/506.1
4,674,644 A * 6/1987 Jacobs ..... 215/320
4,723,674 A * 2/1988 Nunes ..... 215/231
4,794,654 A * 1/1989 Diethelm ..... 4/295
4,799,602 A * 1/1989 Collins et al. ..... 220/789
4,874,108 A * 10/1989 Valasek ..... 220/578
4,907,719 A * 3/1990 Spotholz et al. ..... 222/1
4,944,425 A * 7/1990 Kasugai et al. ..... 220/203.25
4,979,843 A * 12/1990 Perry ..... 403/19
5,004,118 A * 4/1991 England et al. ..... 220/216
5,033,633 A 7/1991 Heilman
5,117,998 A * 6/1992 Handzel ..... 220/578
5,213,230 A 5/1993 Kral
5,219,091 A * 6/1993 Paramski ..... 220/580
5,316,045 A * 5/1994 Taylor ..... 138/89
5,339,981 A * 8/1994 Kral ..... 220/580
5,370,260 A * 12/1994 Paramski ..... 220/580
5,379,907 A * 1/1995 Niedospial et al. ..... 215/247
D356,034 S * 3/1995 Sugrue ..... D9/439
5,398,811 A 3/1995 Latella, Jr.
5,402,908 A * 4/1995 Warden et al. ..... 220/554
5,405,038 A 4/1995 Chuang
D363,429 S * 10/1995 Lee ..... D9/454
5,472,542 A * 12/1995 Wermund ..... 156/245
5,503,189 A * 4/1996 Lamendola ..... 138/96 R
5,553,731 A * 9/1996 Schuyler ..... 220/719
5,564,480 A 10/1996 Chen
5,597,088 A * 1/1997 Fingerle et al. ..... 220/662
5,605,241 A * 2/1997 Imperioli ..... 215/306
5,653,447 A * 8/1997 Cress ..... 277/312
5,707,823 A * 1/1998 Carr et al. ..... 435/29
5,787,516 A * 8/1998 Davenport ..... 4/255.04
5,799,814 A * 9/1998 Schaefer et al. ..... 220/254.1
5,803,284 A * 9/1998 Grimard ..... 215/249
5,806,566 A * 9/1998 Taylor ..... 138/89
5,806,704 A 9/1998 Jamison
5,819,964 A * 10/1998 Grimard ..... 215/249
5,897,019 A * 4/1999 Stropkay ..... 220/713
5,927,183 A * 7/1999 Lee ..... 99/337
5,955,127 A * 9/1999 Glaser ..... 426/106
5,974,686 A * 11/1999 Nomura et al. ..... 34/263
5,979,689 A 11/1999 Lansky
6,082,410 A * 7/2000 Pohar ..... 138/89
6,095,357 A * 8/2000 Heiner et al. ..... 215/270
6,105,810 A * 8/2000 Daenen et al. ..... 220/366.1
D432,857 S 10/2000 Ming-Shiue
6,194,011 B1 * 2/2001 Glaser ..... 426/123

(56) References Cited

U.S. PATENT DOCUMENTS

| | | | | |
|---|---|---|---|---|
| 6,263,781 | B1 * | 7/2001 | Calagui | 99/323 |
| 6,296,136 | B1 * | 10/2001 | Huet | 220/233 |
| 6,307,193 | B1 * | 10/2001 | Toole | 219/735 |
| 6,364,152 | B1 | 4/2002 | Poslinski et al. | |
| 6,478,218 | B1 | 11/2002 | Boatwright et al. | |
| 6,488,173 | B2 | 12/2002 | Milan | |
| 6,490,738 | B2 * | 12/2002 | Blaney | 4/287 |
| 6,659,302 | B2 | 12/2003 | Lin | |
| 6,685,046 | B2 * | 2/2004 | Ogino | 220/367.1 |
| 6,726,047 | B2 * | 4/2004 | Lin | 220/203.11 |
| 6,934,975 | B2 * | 8/2005 | Hope et al. | 4/255.08 |
| 6,945,014 | B1 * | 9/2005 | Quann | 53/432 |
| 6,963,051 | B2 * | 11/2005 | You | 219/436 |
| 6,973,945 | B2 | 12/2005 | Haimi | |
| 7,168,589 | B2 | 1/2007 | Dark | |
| 7,204,383 | B2 | 4/2007 | Hsu | |
| 7,255,244 | B2 * | 8/2007 | Miller | 220/578 |
| 7,299,941 | B2 * | 11/2007 | McMahon et al. | 220/780 |
| 7,464,831 | B2 * | 12/2008 | Aiken | 220/801 |
| 7,571,675 | B1 * | 8/2009 | Cappadona et al. | 99/337 |
| 7,806,044 | B2 | 10/2010 | Lin | |
| 8,011,205 | B2 | 9/2011 | Roth et al. | |
| 8,033,420 | B2 * | 10/2011 | Roseblade et al. | 220/731 |
| 2002/0066732 | A1 | 6/2002 | Ogino | |
| 2004/0238544 | A1 * | 12/2004 | Miller | 220/578 |
| 2004/0262309 | A1 * | 12/2004 | Edwards | 220/233 |
| 2005/0051551 | A1 | 3/2005 | Galletti et al. | |
| 2006/0032852 | A1 | 2/2006 | Cai | |
| 2006/0151511 | A1 | 7/2006 | Kaposi | |
| 2006/0169693 | A1 | 8/2006 | Yeung | |
| 2006/0186130 | A1 * | 8/2006 | Jatzke et al. | 220/789 |
| 2007/0050901 | A1 * | 3/2007 | Hung | 4/295 |
| 2007/0215624 | A1 * | 9/2007 | Smallwood | 220/578 |
| 2007/0241107 | A1 | 10/2007 | Matsumoto et al. | |
| 2007/0292574 | A1 * | 12/2007 | Ling et al. | 426/474 |
| 2008/0190933 | A1 * | 8/2008 | Bougon | 220/361 |
| 2011/0095022 | A1 * | 4/2011 | Yeung | 220/240 |

OTHER PUBLICATIONS

Vacuum_Define Vacuum at Dictionary-com.*
HowStuffWorks_Vacuum.*
Suction cup—Wikipedia, the free encyclopedia.*
Instructions for_Make a Vacuum.*
Physics Force—Physics at Minnesota.*
Progessive—Suction Lid, http://www.progressiveintl.com/prod-detail.asp?ID=GT-3227&Cat=CookwareandAccessories &PerPage=. . . 3 pages.

* cited by examiner

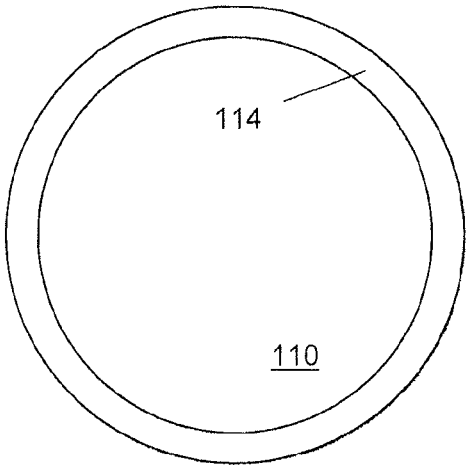
FIG. 4D
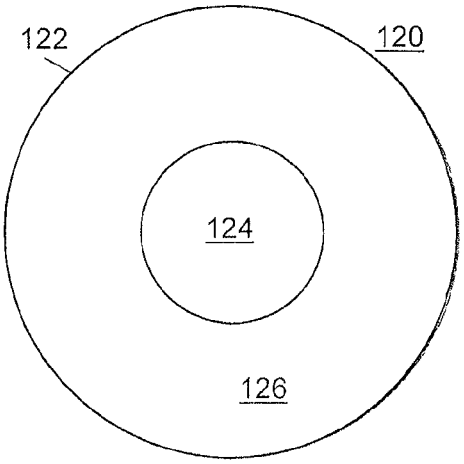
FIG. 4E
FIG. 4F
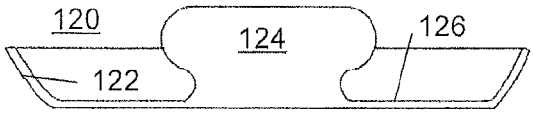
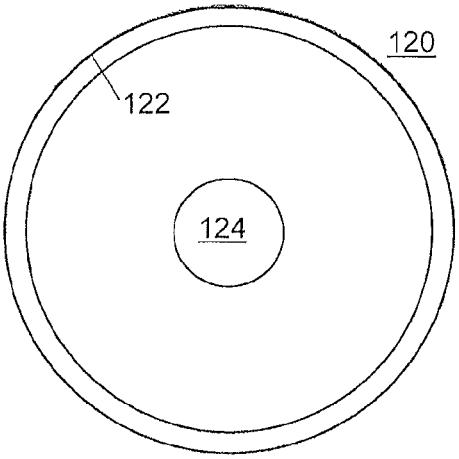
FIG. 4G

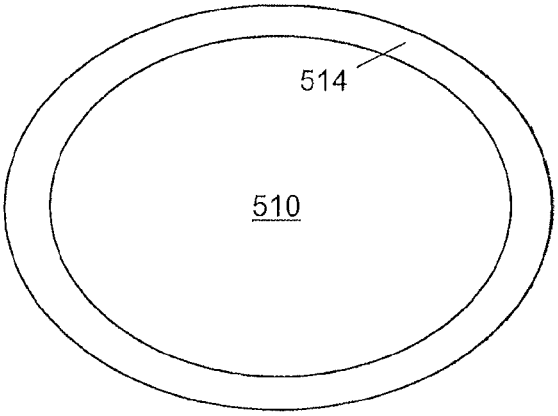
FIG. 5D
FIG. 5E
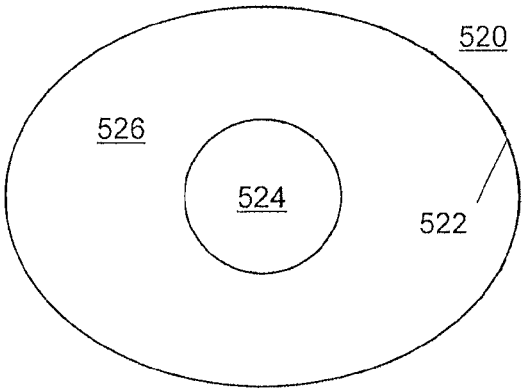
FIG. 5F
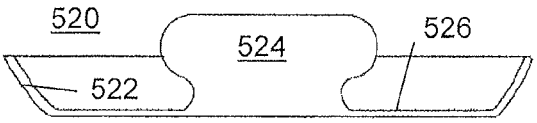
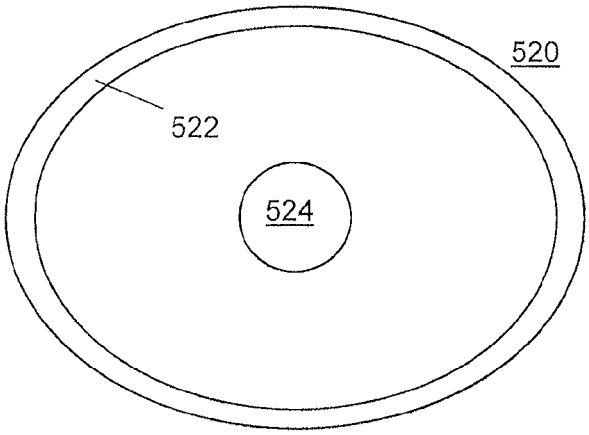
FIG. 5G

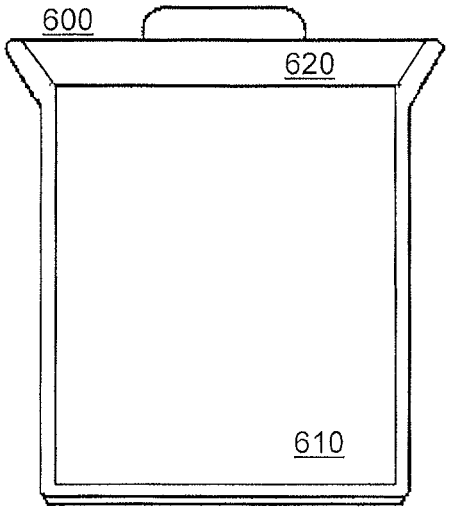
FIG. 6A
FIG. 6B
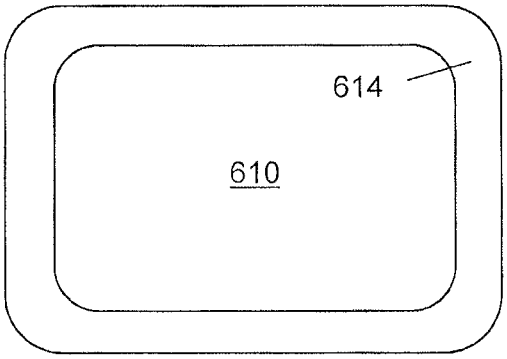
FIG. 6C
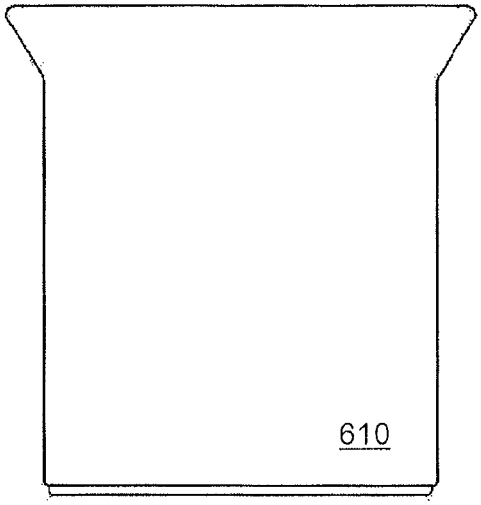
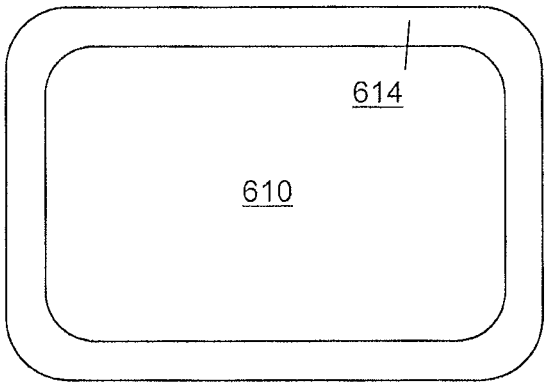
FIG. 6D

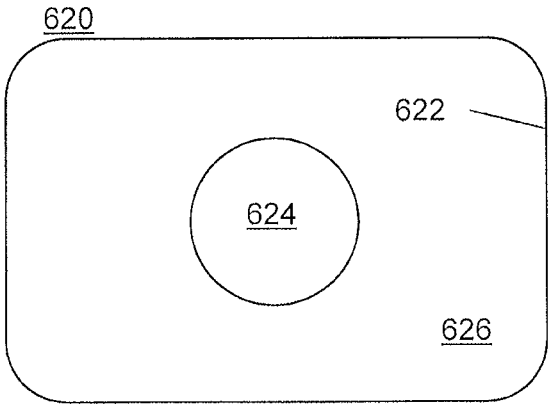
FIG. 6E
FIG. 6F
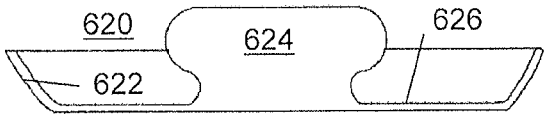
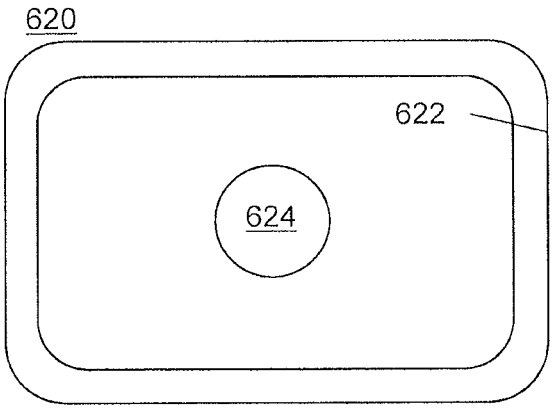
FIG. 6G

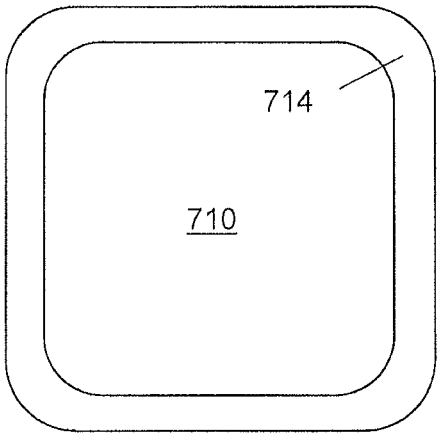
FIG. 7D
FIG. 7E
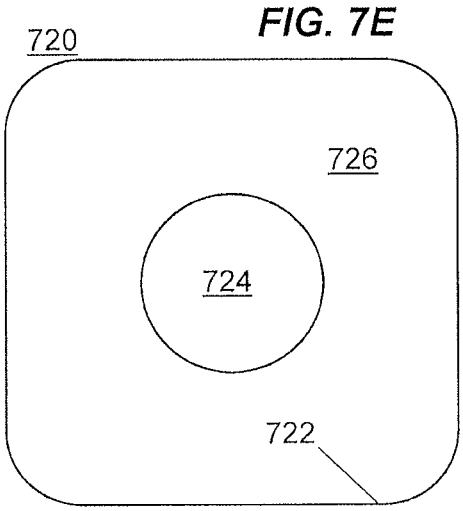
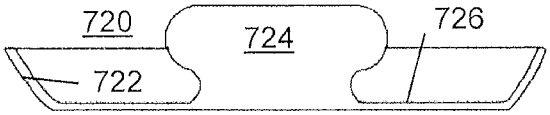
FIG. 7F
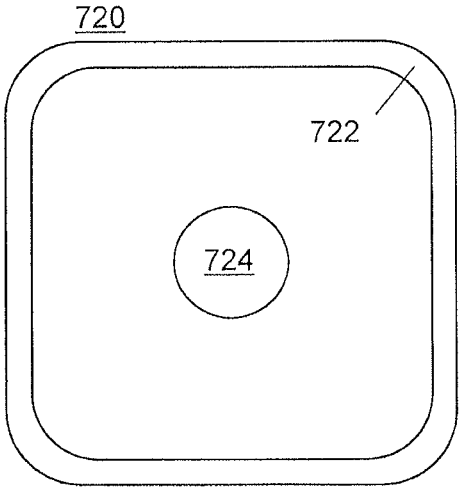
FIG. 7G

AIRTIGHT CANISTER LID WITH FLEXIBLE SEAL-BREAKING BULB

CROSS REFERENCE TO RELATED APPLICATIONS

This application claims priority under 35 U.S.C. §119 to Taiwanese Patent Application No. 096216905, entitled Preserved Canister, filed on Oct. 9, 2007, in the Taiwan Intellectual Property Office, Chinese Patent Application No. 200720177216.0, entitled Preserved Canister with Preserved Lid, filed on Oct. 18, 2007, in the Chinese Patent Office, the disclosures of which are incorporated herein in their entirety by reference.

FIELD OF INTEREST

The present inventive concepts relate to the field of storage containers and canisters, and more particularly to storage containers and canisters having re-sealable lids.

BACKGROUND

Canisters and other storage containers are in widespread use domestically and commercially, collectively referred to herein individually as a "canister" or "container" or as "canisters" or "containers" when there is more than one. It is typical for a canister to have a lid or cover that makes it re-sealable. For example, in food applications lids and covers can be used to keep foods fresh. In some applications it is desirable or necessary to have a canister with an airtight lid—particularly, but not exclusively, in food applications.

One example of a lid that can be used with a container is described in U.S. Patent Publication 2006/032852, entitled Airtight Lid For Container And Method Of Use, published Feb. 16, 2006. This publication describes a lid having a membrane made from a flexible material and having an outer perimeter larger than the rim of the container and a metal enforcement ring for establishing an airtight seal between the membrane and rim of the container. The lid may further comprise an air evacuation passageway having an air collection chamber for extracting air from the container and a valve for allowing air to flow out of the container, but preventing air from entering. The lid can be sealed to a container by pushing the membrane into the container and releasing the membrane to generate a vacuum. Without the enforcement ring the membrane would not form an airtight seal. One disadvantage to this type of lid is that it generally requires two hands to remove the lid, since the container must be steadied and held in place with one hand so the lid edge can be pulled up and away from the edge or rim of the container with the other hand.

Another example of a lid that can be used with a container is described in U.S. Patent Publication 2006/0151511, entitled Suction Cup Lid, published Jul. 13, 2006. This publication describes a lid made from a flexible material, e.g., silicone, forming a convex or other bulged shape. The lid includes a central handle or knob. When place on an opening of a container, the handle can be pressed downward causing the convex shape to be reduced or converted to a concave shape, while evacuating air from the container to form an airtight seal. The lid is made sufficiently wide so that an edge of the lid extends past the rim of the container. This allows the edge of the lid to be lifted up and away from the container to break the seal and remove the lid. Like the lid above, a disadvantage to this type of lid is that it generally requires two hands to remove the lid, since the container must be steadied and held in place with one hand so the lid edge can be pulled up and away from the edge or rim of the container with the other hand.

Another example of a lid that can be used with a container is described in U.S. Patent Publication 2006/0169693, entitled Silicone Lid For Sealing Any Type Of Open-Ended Container, published Aug. 3, 2006. This publication describes a lid that can be sealed to a container by placing a bottom of the lid on an open-ended side of the container and depressing the top, forcing air out of the container and forming a vacuum seal. The lid is substantially flat and wider than the opening it is sealing. To remove the lid a protrusion that extends outwardly from an edge of the lid is pulled up and toward the center of the lid to break the vacuum seal—i.e., to open the container. Similar to the lids described above, a disadvantage to this type of lid is that it generally requires two hands to remove the lid, since the container must be steadied and held in place with one hand so the lid can be pulled up and away from the edge or rim of the container with the other hand.

SUMMARY OF INVENTION

In accordance with one aspect of the present disclosure, provided is a canister comprising: a vessel defining a volume and an opening having a rim; and a lid comprising a flexible bulb and a conformal outer edge configured to create an airtight seal with the rim to close the opening, wherein the flexible bulb is configured to release pressure from the vessel and break the airtight seal in response to compression of the bulb.

The lid can be configured to evacuate air from the vessel and to create the airtight seal between the conformal outer edge and the rim in response to pressure applied to the lid in the direction of the volume.

The lid can further comprises a pliable top member between the conformal outer edge and flexible bulb.

The lid can comprise rubber.

The lid can comprise silicone.

The vessel can be made from a material comprising at least one of ceramic, acrylic, metal, resin, plastic, wood, stone or glass.

The rim and conformal outer edge can have a circular shape.

The rim and conformal outer edge can have an oval shape.

The rim and conformal outer edge can have a rectangular shape.

The rim and conformal outer edge can have a square shape.

The rim can have a flare shape and the conformal edge can have a corresponding flare shape configured to fit within the rim to make the airtight seal.

In accordance with another aspect of the invention, provided is a lid for use with a vessel defining a volume and an opening having a rim. The lid comprises a flexible bulb and a conformal outer edge configured to create an airtight seal with the rim to close the opening, wherein the flexible bulb is configured to release pressure from the vessel and break the airtight seal in response to compression of the bulb.

The lid can be configured to evacuate air from the vessel and to create the airtight seal between the conformal outer edge and the rim in response to pressure applied to the lid in the direction of the volume.

The lid can further comprise a pliable top member between the conformal outer edge and flexible bulb.

The lid can comprise rubber.

The lid can comprise silicone.

The conformal outer edge can have a circular shape.

The conformal outer edge can have an oval shape.

The conformal outer edge can have a rectangular shape.

The conformal outer edge can have a square shape.

The conformal edge can have a flare shape configured to fit within the rim to make the airtight seal.

BRIEF DESCRIPTION OF THE DRAWINGS

The present invention will become more apparent in view of the attached drawings and accompanying detailed description. The embodiments depicted therein are provided by way of example, not by way of limitation, wherein like reference numerals refer to the same or similar elements. In the drawings:

FIGS. 4A-4G are various views of a circular canister in accordance with aspects of the present invention, such as that shown in FIGS. 1-3.

FIGS. 5A-5G are various views of an oval canister in accordance with aspects of the present invention.

FIGS. 6A-6G are various views of a rectangular canister in accordance with aspects of the present invention.

FIGS. 7A-7G are various views of a square canister in accordance with aspects of the present invention.

DETAILED DESCRIPTION OF PREFERRED EMBODIMENT

It will be understood that, although the terms first, second, etc. may be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Figure 1:
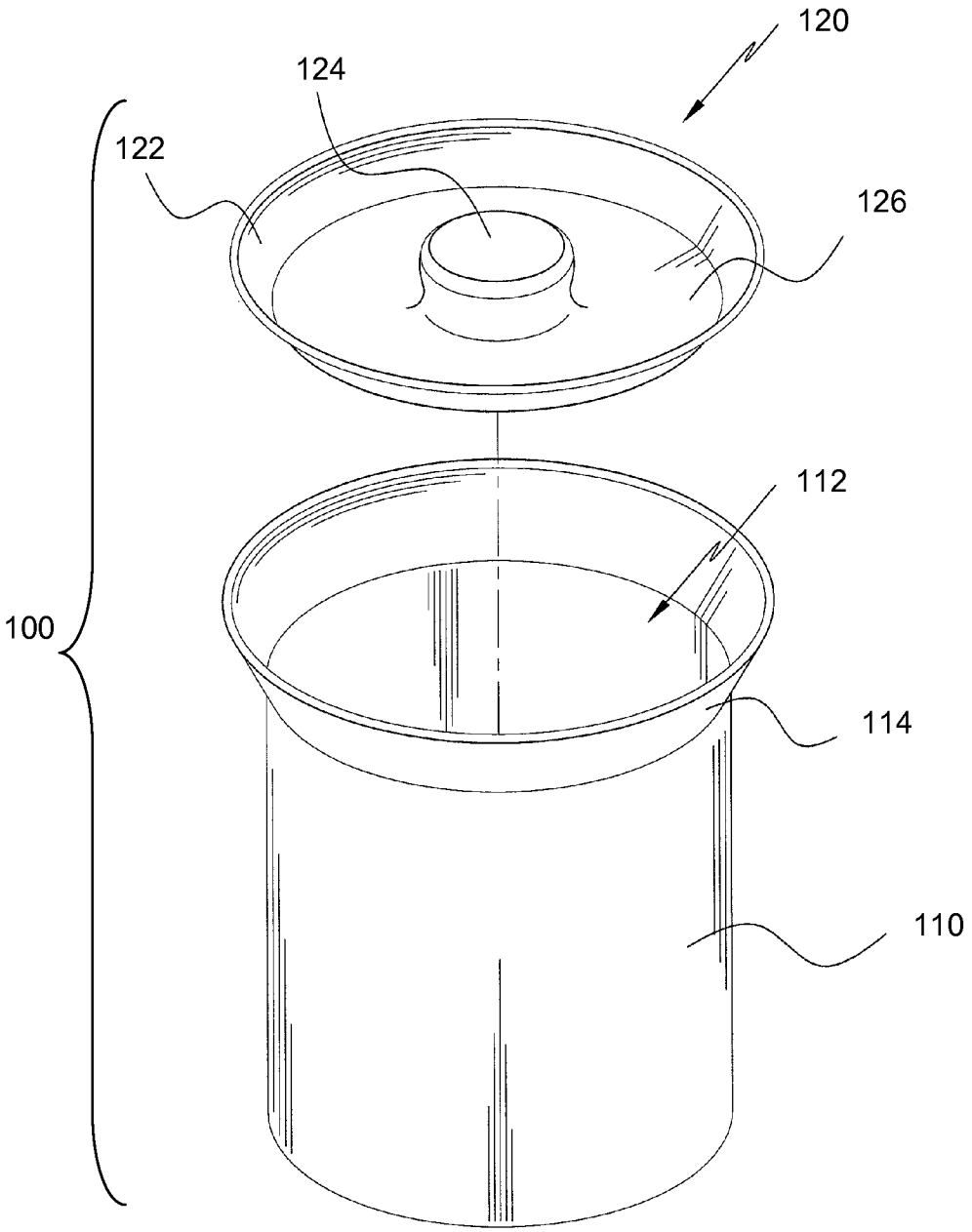
FIG. 1 is a perspective view of a canister in accordance with one aspect of the present invention.

FIG. 1 provides a perspective view of one embodiment of a canister 100. In this embodiment, the canister 100 comprises a cylindrical vessel 110 and a lid 120. The vessel 110 defines an internal volume and has an open end 112 defined by a rim 114. The vessel 110 can be comprised of any of a variety of materials, including metal, ceramic, glass, resin, acrylic, plastic, wood, stone, or a combination thereof—as examples.

Lid 120 is configured to close the open end 112 of the vessel 110 by creating an airtight seal with the rim 114. The lid 120 includes a conformal outer edge 122 and a flexible bulb 124. Between the conformal outer edge 122 and bulb 124 there is a top member 126. In this embodiment the top member is substantially planar and pliable. As will be discussed in greater detail below, the conformal edge 122 is particularly useful in creating the airtight with an inner surface of rim 114 and the flexible bulb is particularly useful in breaking the airtight seal for removal of lid 120 from vessel 110. The lid 120 can be comprised of a flexible material, such as silicone, rubber, plastic, polypropylene, or a combination thereof—as examples.

Figure 2A:
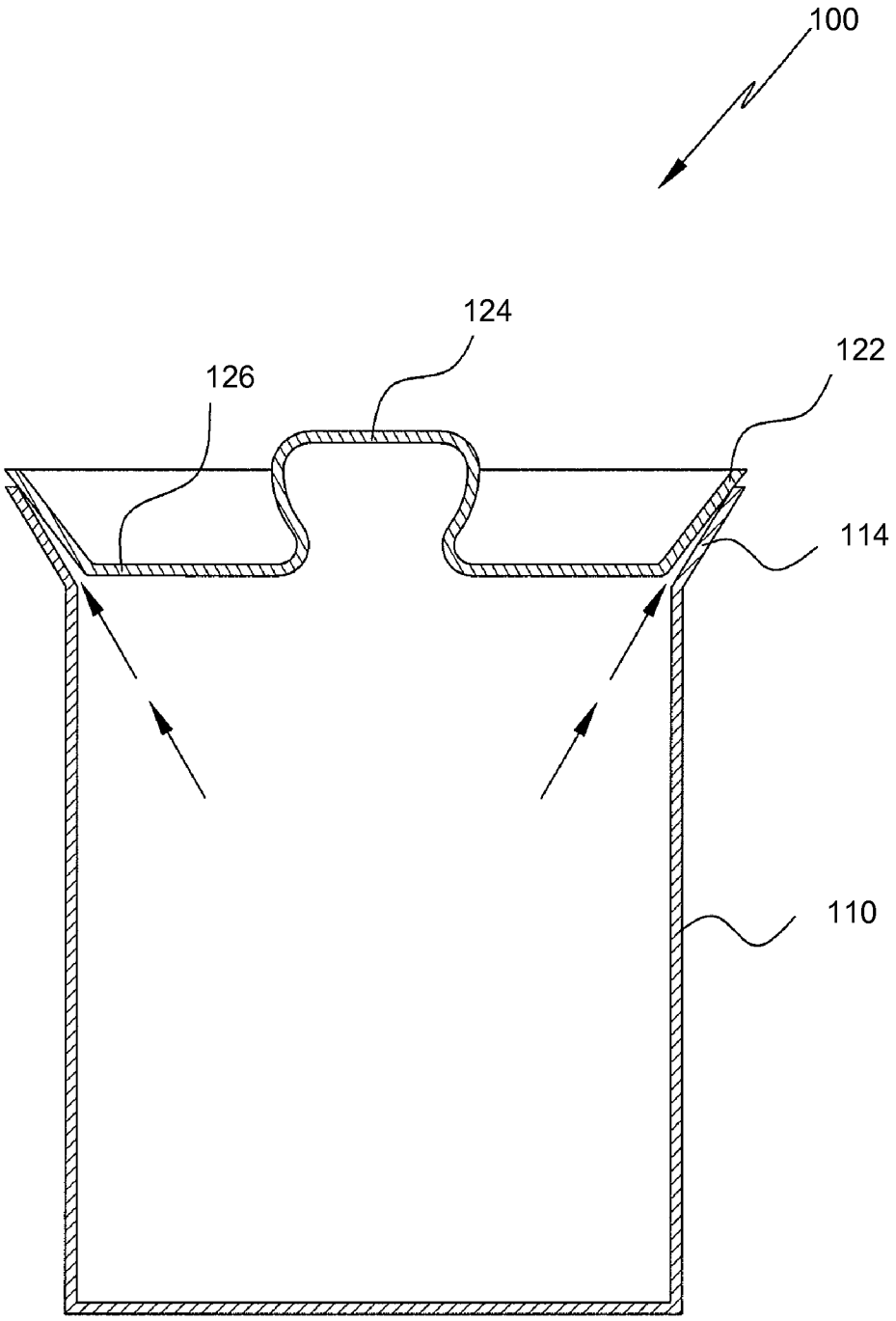
FIG. 2A-2C are cross-sectional side views of the canister of FIG. 1 demonstrating principles of the invention related to creating an airtight seal.
Figure 2B:
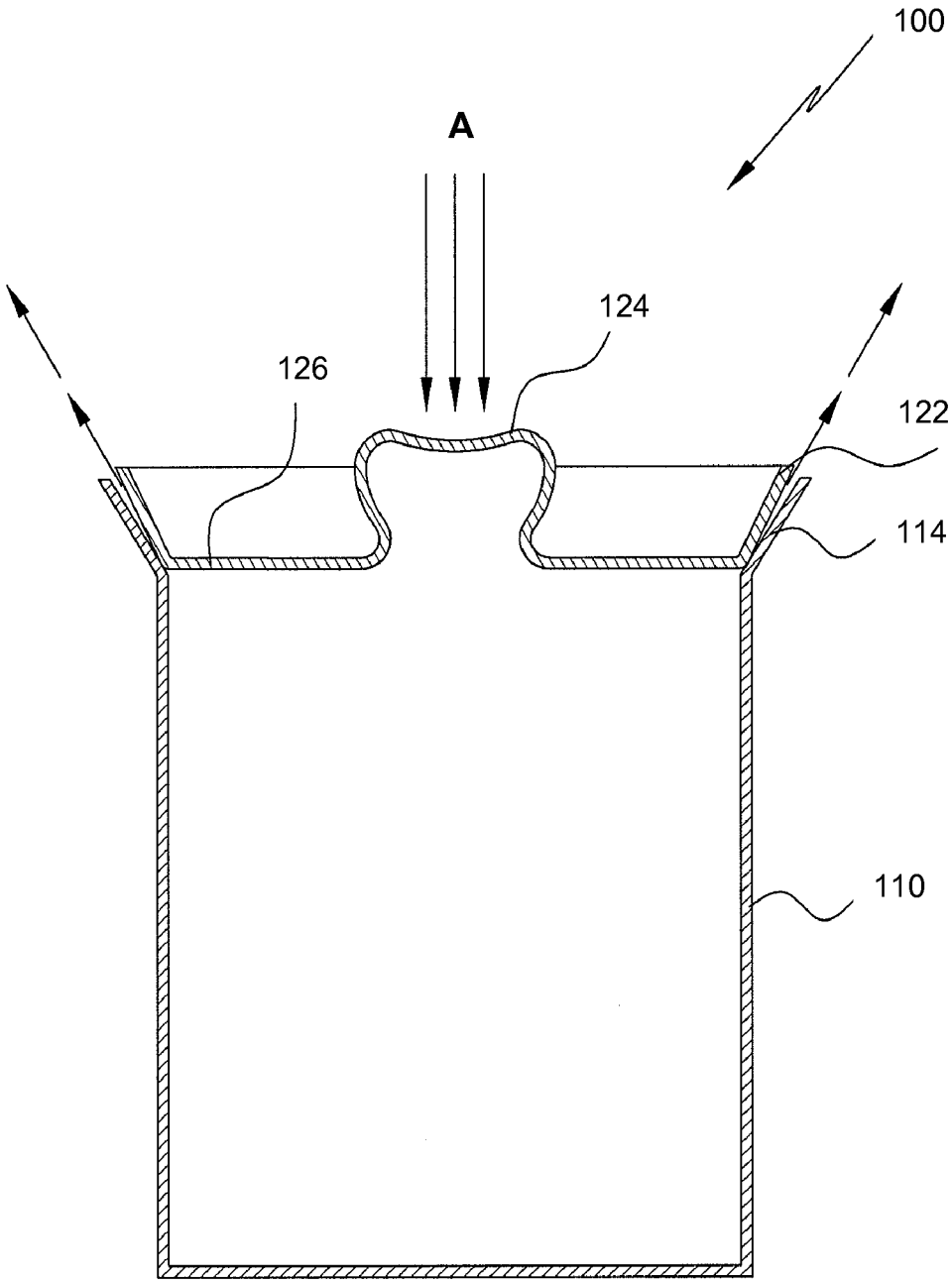
Figure 2C:
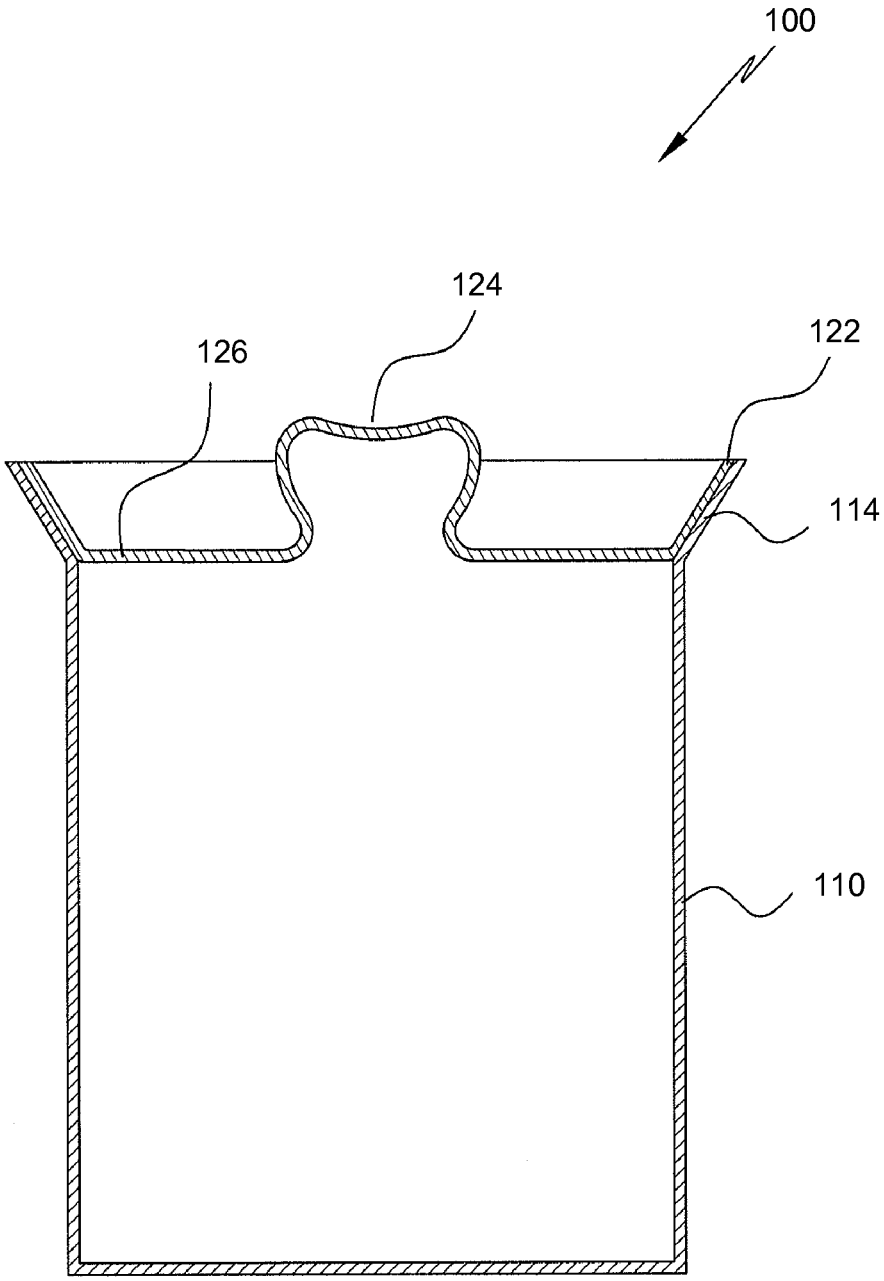

FIGS. 2A-2C are cross-sectional side views of the canister 100 of FIG. 1. These views demonstrate principles of the invention with respect to the evacuation of air from the canister when the lid 120 is used to close the open end 112 of vessel 110.

FIG. 2A shows the lid 120 at rest on the inner surface of rim 114. At this point, air has yet to be released from the vessel and a secure airtight seal has not been created. The arrows in this figure represent air inside the vessel 110 and the direction the air will be forced out thereof.

FIG. 2B shows that when downward pressure is applied to flexible bulb 124 air is forced out of the vessel 110, as indicated by the arrows "A." As the flexible bulb 124 is pushed into the open end 112 of vessel 110 the air inside the vessel 110 is forced out through the ever-decreasing gaps between the conformal edge 122 of the lid 120 and the inner surface of the rim 114.

FIG. 2C shows that as air is forced out of the vessel 110 a vacuum is created inside vessel 110, which causes the conformal edge 122 of the lid 120 to be pulled into an airtight, mated engagement with the inner surface of rim 114. As the airtight seal is made, the bulb 124, after having been depressed, and top member 126 attempt to return to their original shapes and positions creating the vacuum necessary to create the airtight seal.

Tests with prototypes having a silicone lid used with a ceramic vessel have shown that an airtight seal is created that has enough strength to enable the canister to be lifted by the bulb without breaking the airtight seal. Although, the ability to lift the canister by the flexible bulb need not be realized in all embodiments.

Figure 3:
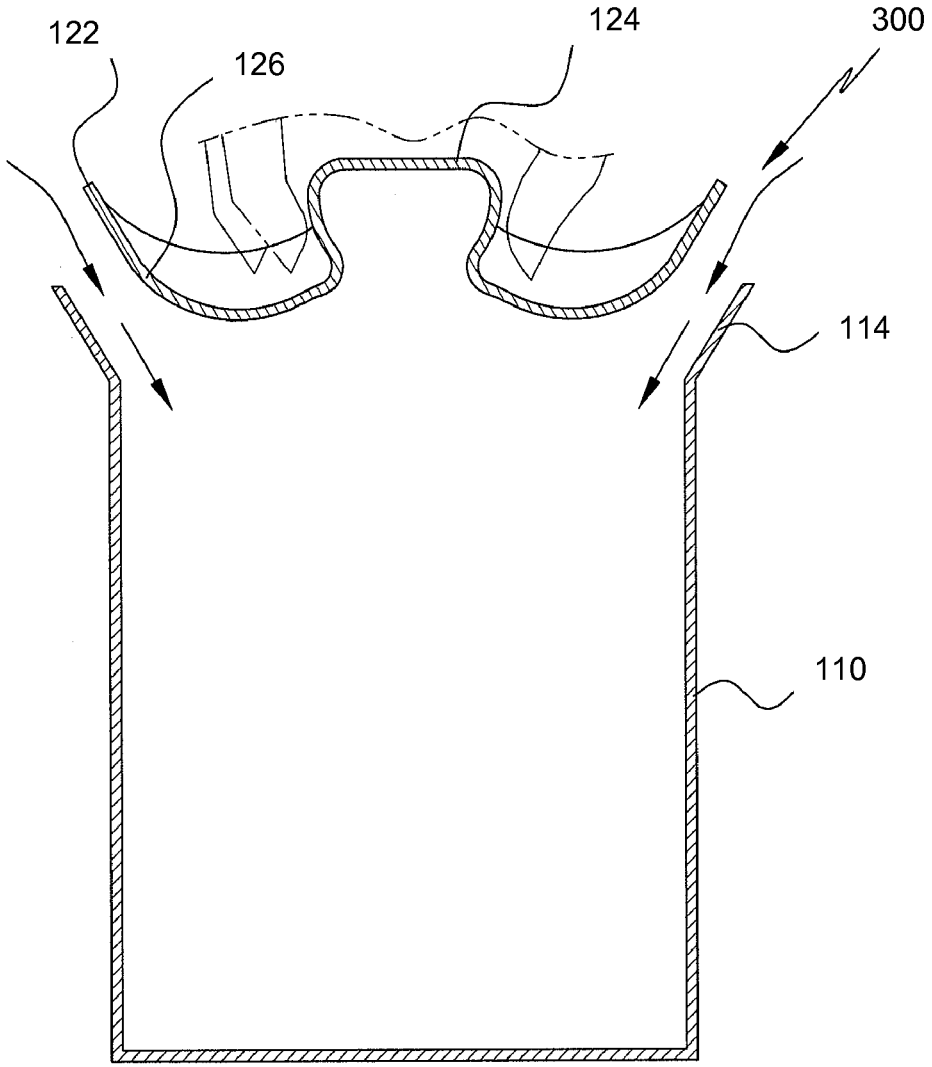
FIG. 3 is a cross-sectional side view of the canister of FIGS. 1 and 2A-2C demonstrating principles of the invention related to breaking the airtight seal.

FIG. 3 is a cross-sectional side view of the canister of FIGS. 1 and 2A-2C demonstrating principles of the invention related to breaking the airtight seal. In this embodiment, the airtight seal between the vessel rim 114 and the conformal edge 122 of lid 120 is achieved by squeezing the flexible bulb 124. The flexible bulb 124 is substantially hollow in this embodiment to enable compression to force air into the vessel to facilitate breaking of the airtight seal in response to such compression.

As demonstrated in FIG. 3, squeezing the flexible bulb 124 also draws at least a portion of the conformal edge away from the rim 114 creating an opening 300 therebetween. The vacuum or suction that was created when making the airtight seal rapidly draws air into the vessel 110 through the opening. As air quickly fills the vessel 110, the vacuum or suction is eliminated and the entire seal between the conformal edge 122 of lid 120 and the inner surface of rim 114 of vessel 110 is broken.

In this embodiment, the vessel rim 114 has a flared shape, as does conformal edge 122 of lid 120. This shape is generally preferable because: (1) it allows a larger degree of surface area for making the airtight seal between the vessel 110 and the lid 120, which provides a better seal; (2) is configured to create a desirable flow path for air being evacuated from the vessel during sealing; (3) completely contains the lid within the vessel 110 perimeter, so there is no overhang that would make the lid vulnerable to external forces that could unintentionally break the airtight seal; and (4) offers resistance to the lid being sucked into the vessel 110 by the vacuum created in the vessel during the sealing process.

Figure 4A:
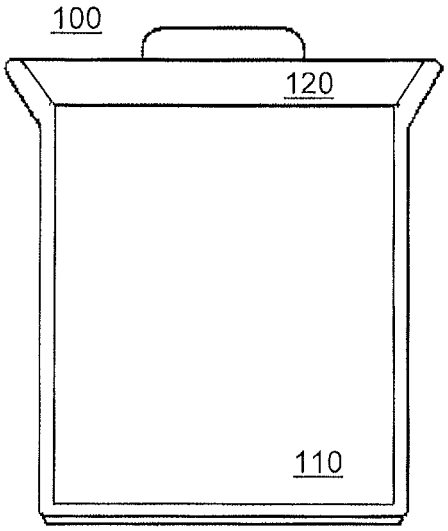
Figure 4B:
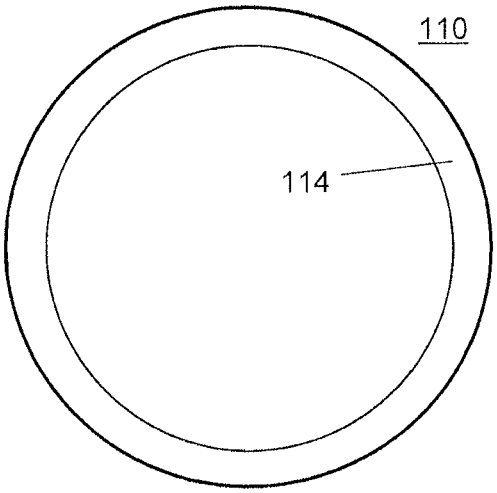
Figure 4C:
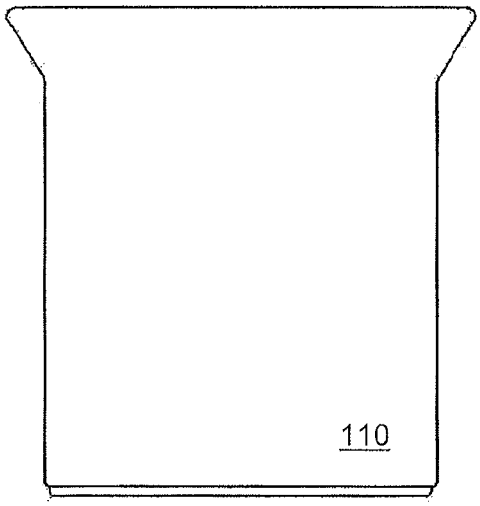

FIGS. 4A-4G show various views of a circular canister in accordance with the embodiment of FIGS. 1-3. FIG. 4A shows a side view of canister 100, including vessel 110 and lid 120. FIG. 4B shows a top view of vessel 110, including the inner surface of rim 114. FIG. 4C shows a side view of vessel 110, including rim 114. FIG. 4D shows a bottom view of vessel 110.

FIG. 4E shows a top view of lid 120, including flexible bulb 124. FIG. 4F shows a side view of lid 120, including top member 126, flexible bulb 124, and conformal edge 122. FIG. 4G shows a bottom view of lid 120, including an inner portion of flexible bulb 124 and a portion of conformal edge 122 that mates with the inner surface of vessel rim 114. The flexible bulb is substantially hollow in this embodiment.

Figure 5A:
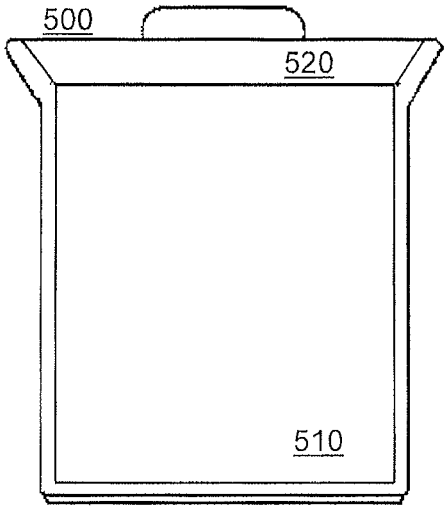
Figure 5B:
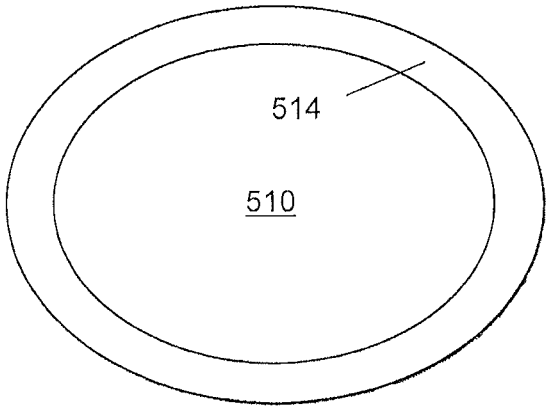
Figure 5C:
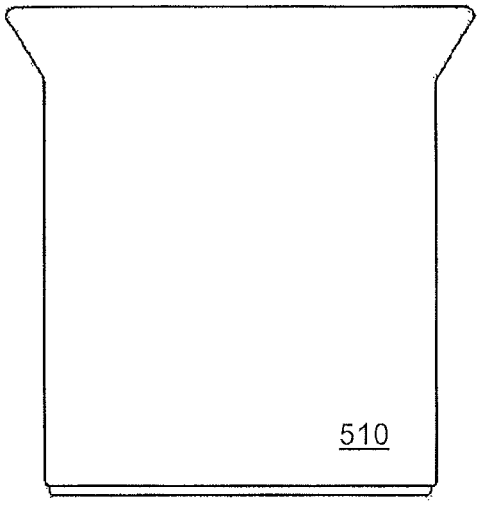

FIGS. 5A-5G show various views of an oval canister 500 in accordance with another embodiment. The canister 500 includes an oval vessel 510 and an oval lid 520. The principles relating to creating and breaking an airtight seal between the vessel and lid described above with respect to FIGS. 1-3 also apply to the embodiment of FIGS. 5A-5G. FIG. 5A shows a side view of canister 500, including the vessel 510 and the lid 520. FIG. 5B shows a top view of the vessel 510, including an inner surface of a rim 514 of vessel 510. FIG. 5C shows a side view of vessel 510, including rim 514. FIG. 5D shows a bottom view of vessel 510.

FIG. 5E shows a top view of lid 520, including a flexible bulb 524. Flexible bulb 524 is configured to perform sealing and seal breaking functions corresponding to those described above with respect to flexible bulb 124. FIG. 5F shows a side view of lid 520, including a top member 526, flexible bulb 524, and a conformal edge 522 that is configured for airtight engagement with the inner surface of rim 514. FIG. 5G shows a bottom view of lid 520, including an inner, substantially hollow portion of flexible bulb 524 and a portion of conformal edge 522 that mates with the inner surface of vessel rim 514.

FIGS. 6A-6G show various views of a rectangular canister 600 in accordance with another embodiment. The canister 600 includes a rectangular vessel 610 and a rectangular lid 620. The principles relating to creating and breaking an airtight seal between the vessel and lid described above with respect to FIGS. 1-3 also apply to the embodiment of FIGS. 6A-6G. FIG. 6A shows a side view of canister 600, including the vessel 610 and the lid 620. FIG. 6B shows a top view of the vessel 610, including an inner surface of a rim 614 of vessel 610. FIG. 6C shows a side view of vessel 610, including rim 614. FIG. 6D shows a bottom view of vessel 610.

FIG. 6E shows a top view of lid 620, including a flexible bulb 624. Flexible bulb 624 is configured to perform sealing and seal breaking functions corresponding to those describe above with respect to flexible bulb 124. FIG. 6F shows a side view of lid 620, including a top member 626, flexible bulb 624, and a conformal edge 622 that is configured for airtight engagement with the inner surface of rim 614. FIG. 6G shows a bottom view of lid 620, including an inner, substantially hollow portion of flexible bulb 624 and a portion of conformal edge 622 that mates with the inner surface of vessel rim 614.

Figure 7A:
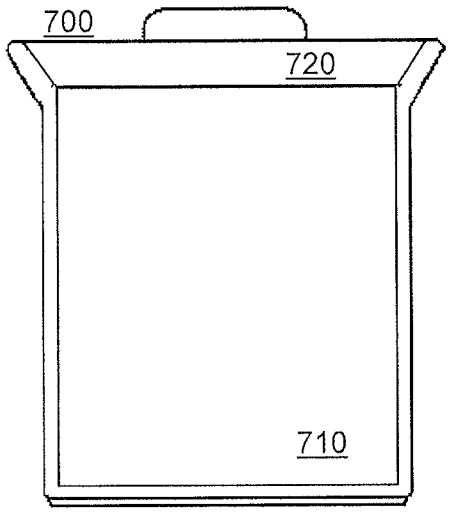
Figure 7B:
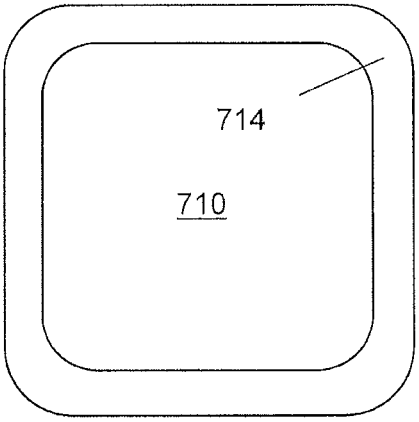
Figure 7C:
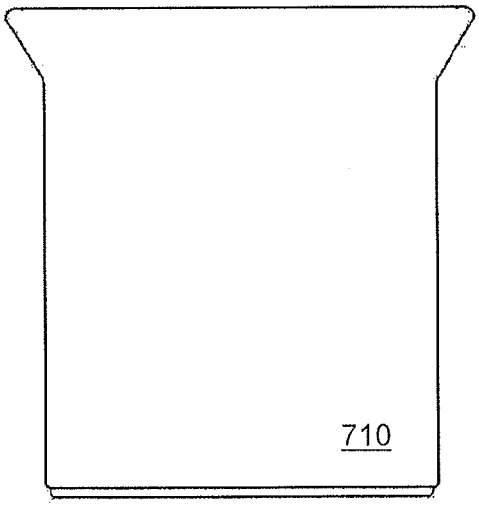

FIGS. 7A-7G show various views of a square canister 700 in accordance with another embodiment. The canister 700 includes a square vessel 710 and a square lid 720. The principles relating to creating and breaking an airtight seal between the vessel and lid described above with respect to FIGS. 1-3 also apply to the embodiment of FIGS. 7A-7G. FIG. 7A shows a side view of canister 700, including the vessel 710 and the lid 720. FIG. 7B shows a top view of the vessel 710, including an inner surface of a rim 714 of vessel 710. FIG. 7C shows a side view of vessel 710, including rim 714. FIG. 7D shows a bottom view of vessel 710.

FIG. 7E shows a top view of lid 720, including a flexible bulb 724. Flexible bulb 724 is configured to perform sealing and seal breaking functions corresponding to those describe above with respect to flexible bulb 124. FIG. 7F shows a side view of lid 720, including a top member 726, flexible bulb 724, and a conformal edge 722 that is configured for airtight engagement with the inner surface of rim 714. FIG. 7G shows a bottom view of lid 720, including an inner, substantially hollow portion of flexible bulb 724 and a portion of conformal edge 722 that mates with the inner surface of vessel rim 714.

As will be appreciated by those skilled in the art, canisters, vessels, and could take other shapes not explicitly disclosed herein without departing from the spirit and scope of the invention.

While the foregoing has described what are considered to be the best mode and/or other preferred embodiments, it is understood that various modifications may be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. A canister comprising:

a vessel defining a volume and an opening having a rim with a flared inner surface, the rim including a rim top distal from the volume that has a greater diameter than a rim bottom proximate to the volume; and a flexible lid having a flexible hollow bulb centrally disposed in a substantially planar and pliable top member and a planar flared conformal outer edge extending upwardly from a perimeter of the pliable top member, wherein the flared conformal outer edge is configured to mate with the flared inner surface of the rim to close the opening so there is no overhang with the rim top, the pliable top member extending between the flexible hollow bulb and the flared conformal outer edge, wherein the pliable top member, flexible hollow bulb, and conformal outer edge are configured such that:

pressing the lid into the opening evacuates air from the vessel away from the flexible hollow bulb and around and between the flared inner surface of the rim and the flared conformal outer edge of the lid to create a vacuum that pulls the lid to close the opening with a vacuum airtight seal, and compressing the flexible bulb forces air into the vessel that is then directed out of the vessel via the flared inner surface of the rim and the flared conformal outer edge of the lid to break the vacuum airtight seal.

2. The canister of claim 1, wherein the lid comprises rubber.

3. The canister of claim 1, wherein the lid comprises silicone.

4. The canister of claim 1, wherein the vessel is made from a material comprising at least one of ceramic, acrylic, metal, resin, plastic, wood, stone or glass.

5. The canister of claim 1, wherein the rim and conformal outer edge have a circular shape.

6. A flexible lid for use with a vessel defining a volume and an opening having a rim with a flared inner surface, the rim including a rim top distal from the volume that has a greater diameter than a rim bottom proximate to the volume, the lid comprising:

a substantially planar and pliable top member;

a flexible hollow bulb centrally disposed in the pliable top member; and a planar flared conformal outer edge extending upwardly from a perimeter of the pliable top member, wherein the flared conformal outer edge is configured to mate with the flared inner surface of the rim to close the opening so there is no overhang with the rim top, the pliable top member extending between the flexible hollow bulb and the flared conformal outer edge, wherein the pliable top member, flexible hollow bulb, and conformal outer edge are configured such that:

pressing the lid into the opening evacuates air from the vessel around and between the flared inner surface of the rim and the flared conformal outer edge of the lid to create a vacuum that pulls the lid to close the opening with a vacuum airtight seal, and compressing the flexible bulb forces air into the vessel that is then directed out of the vessel via the flared inner surface of the rim and the flared conformal outer edge of the lid to break the vacuum airtight seal.

7. The lid of claim 6, wherein the lid comprises rubber.

8. The lid of claim 6, wherein the lid comprises silicone.

9. The lid of claim 6, wherein the conformal outer edge has a circular shape.

10. The canister of claim 1, wherein the flexible bulb returns to an uncompressed state upon removal of the compression.

11. The canister of claim 1, wherein the vessel and lid are made from silicone.

12. The canister of claim 1, wherein pressing the flexible bulb of the lid in the direction of the vessel volume evacuates the air from the vessel via the flared inner surface of the rim and the flared conformal outer edge of the lid to create the vacuum that pulls the lid to close the opening with the vacuum airtight seal.

13. The lid of claim 6, wherein the flexible bulb returns to an uncompressed state upon removal of the compression.

14. The lid of claim 6, wherein the vessel and lid are made from silicone.

15. The lid of claim 6, wherein pressing the flexible bulb of the lid in the direction of the vessel volume evacuates the air from the vessel via the flared inner surface of the rim and the flared conformal outer edge of the lid to create the vacuum that pulls the lid to close the opening with the vacuum airtight seal.

* * * * *